United States Patent [19]

Sanchez

[11] Patent Number: 4,673,813

[45] Date of Patent: Jun. 16, 1987

[54] MULTI-DOSE RADIO-ISOTOPE CONTAINER

[75] Inventor: Lawrence Sanchez, Albuquerque, N. Mex.

[73] Assignee: Nuclear Medical Products, Inc., Los Lunas, N. Mex.

[21] Appl. No.: 739,145

[22] Filed: May 30, 1985

[51] Int. Cl.[4] ..... G21F 5/00

[52] U.S. Cl. ..... 250/506.1; 376/272; 220/253; 220/254

[58] Field of Search ..... 250/506.1, 496.1; 376/272; 220/253, 254, 255, 256

[56] References Cited

U.S. PATENT DOCUMENTS

| | | | |
|---|---|---|---|
| 2,449,285 | 9/1948 | Ekstrom | 220/253 |
| 4,057,167 | 11/1977 | Lee | 220/254 |
| 4,081,688 | 3/1978 | Fries | 250/506.1 |
| 4,141,461 | 2/1979 | LaChance | 220/253 |
| 4,302,680 | 11/1981 | Ahmer et al. | 250/506.1 |
| 4,513,204 | 4/1985 | Dommanovich et al. | 250/506.1 |

*Primary Examiner*—Bruce C. Anderson

*Attorney, Agent, or Firm*—Paul J. Cook

[57] ABSTRACT

A multi-dose container for radio-isotopes comprises a body having a cover. The cover contains a slidable portion which opens to reveal a small opening for withdrawing the contents of the container. The slidable portion is spring loaded and locks in the open position by engaging holding means formed on the cover. The cover contains a release bar which, when pressed, removes the holding means from engagement with the slidable portion and allows the spring to return the slidable portion to a closed position. The operation can easily be performed with one hand.

9 Claims, 8 Drawing Figures

MULTI-DOSE RADIO-ISOTOPE CONTAINER

TECHNICAL FIELD

This invention relates to containers and more particularly to containers for radioactive isotopes. Still more particularly, it relates to such containers having facile opening and closing means whereby exposure to radiation by workers using the container is minimized.

BACKGROUND OF THE INVENTION

Present containers used for storing radio-isotopes often expose technicians using the same to unnecessary radiation since, in order for the technician to withdraw a dose, the entire top or cap of the container must be removed. Some of these containers are designed for one time use with no means for securing or locking the top on the bottom portion of the container. Many of the presently used containers employ tops that are secured only by the use of tape or heat shrinking plastic film.

SUMMARY OF THE INVENTION

It is, therefore, an object of the invention to obviate the disadvantages of the prior art.

It is another object of the invention to enhance containers for radio-isotopes.

It is yet another object of the invention to provide a container that is re-sealable.

Yet another object of the invention is the provision of a container that opens and closes easily with one hand.

These objects are accomplished, in one aspect of the invention, by the provision of a container for radio-isotopes which comprises a first hollow body formed of a material substantially impervious to radiation having a cover of like material affixed thereto. The cover has a formed depression in the upper surface thereof and the depression contains an aperture communicating with the interior. A second hollow body receives the first body and is closed by a second cover. The second cover has a dependent boss formed on the interior surface thereof, the boss having a configuration matching the depression formed in the first cover. The boss also contains an aperture which is aligned with the first aperture. A slidable portion is formed to engage an opening in the upper surface of the second cover, and holding and releasing means for the slidable portion are also formed on the second cover.

Movement of the slidable portion from a closed to an open position exposes the apertures, allowing a dose to be extracted from the container. The slidable portion is easily controlled with one hand and is quickly closed by actuating the release means.

This container thus eliminates the above-recited problems with prior art containers.

DESCRIPTION OF THE PREFERRED EMBODIMENTS

For a better understanding of the present invention, together with other and further objects, advantages and capabilities thereof, reference is made to the following disclosure and appended claims taken in conjunction with the above-described drawings.

Figure 1:
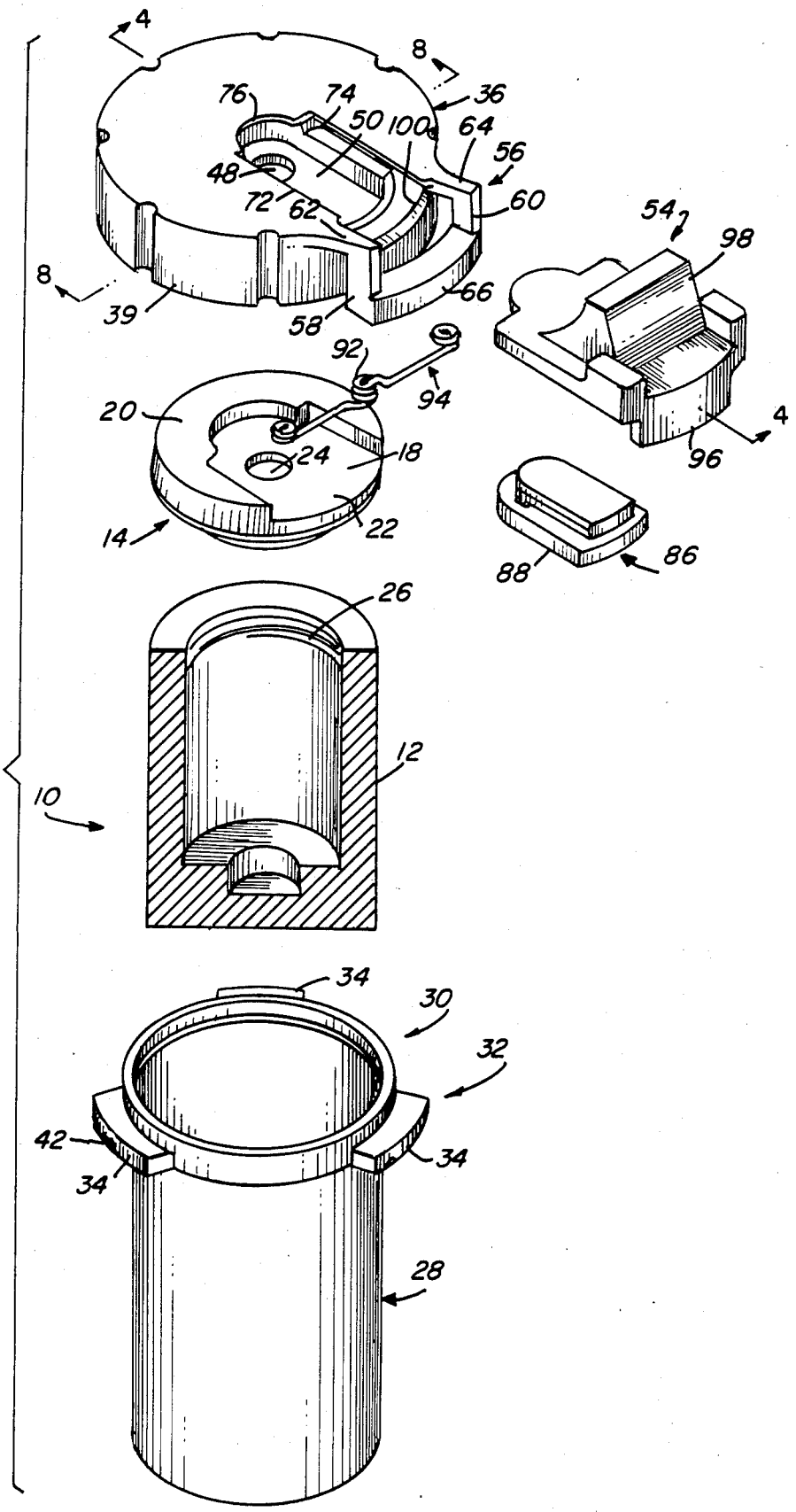
FIG. 1 is an exploded, perspective view of a container in accordance with an aspect of the invention.
Figure 8:
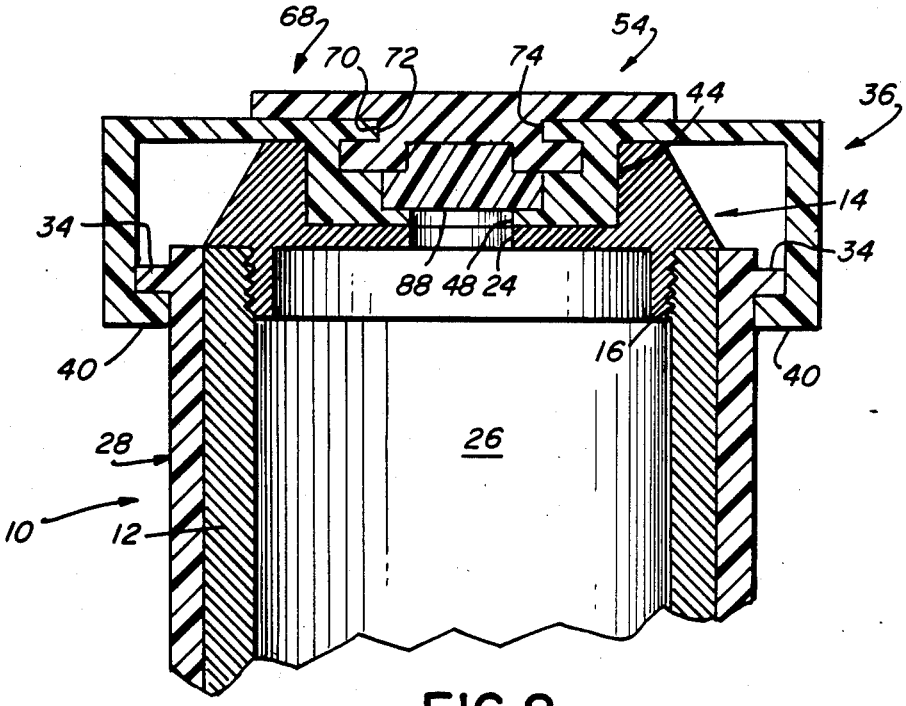
FIG. 8 is a partial, elevational, sectional view taken along the line 8—8 of FIG. 1.

Referring now to the drawings with greater particularity, there is shown in FIG. 1 a multi-dose container 10 for radioisotopes. Container 10 comprises a first hollow body 12, substantially cylindrical, having a depression 13 formed in the bottom 15 thereof, so that vials of different heights and diameters can be accomodated therein. First body 12 is formed of a material substantially impervious to radiation, e.g., lead; and having a first cover 14 of similar characteristics affixed thereto, as by threaded coupling 16 (see FIG. 8) or in any other suitable manner. The first cover 14 has a formed depression 18 in the upper surface 20 thereof, and a planar surface 22 of depression 18 has a first aperture 24 therethrough which communicates with the interior of the first body 12.

The first body 12 fits inside a second hollow body 28, which can be formed of an injection molded material such as polysyrene. The upper or open end 30 of second body 28 is provided with locking means 32 such as grooved dog stops 34, spaced about the periphery of body 28, for receiving and locking a second cover 36, the interior periphery 38 of the wall 39 which is provided with mating dog stops 40 having projections 42 thereon for receiving grooves 42 on stops 34.

A dependent bos 44 is formed on the interior surface 46 of cover 36 and has a configuration formed to match the depression 18 in the first cover 14.

A second aperture is formed in boss 44 and, when container 10 is assembled, is aligned with first aperture 24.

An opening 50 is provided in the upper surface 52 of cover 36. Opening 50 is above, and forms an entrance into, boss 44. A slidable portion 54 is formed to engage opening 50 and slidable portion holding and releasing means 56 are formed on cover 36 and project therefrom, in axial alignment with opening 50.

The slidable portion holding and releasing means 56 comprises a pair of spaced projections 58, 60, extending from cover 36 and have raised sections 62, 64, on a surface thereof. A release bar 66 is connected between the projections 58, 60, and has a stop 67 thereon, extending toward wall 39, to prevent excess movement of the release bar 66.

Figure 2:
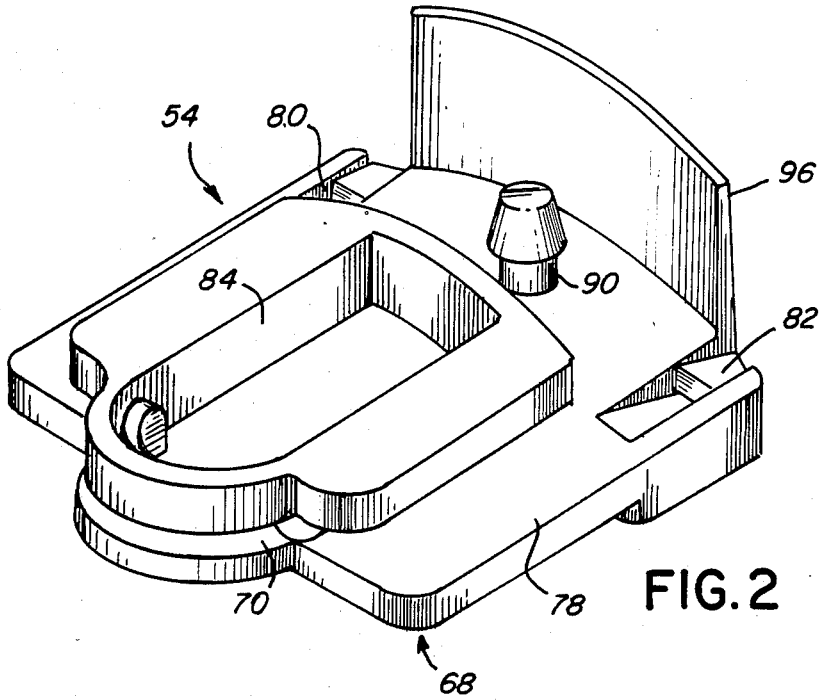
FIG. 2 is a perspective view of the slidable portion in a position rotated 180 degrees from that shown in FIG. 1.
Figure 3:
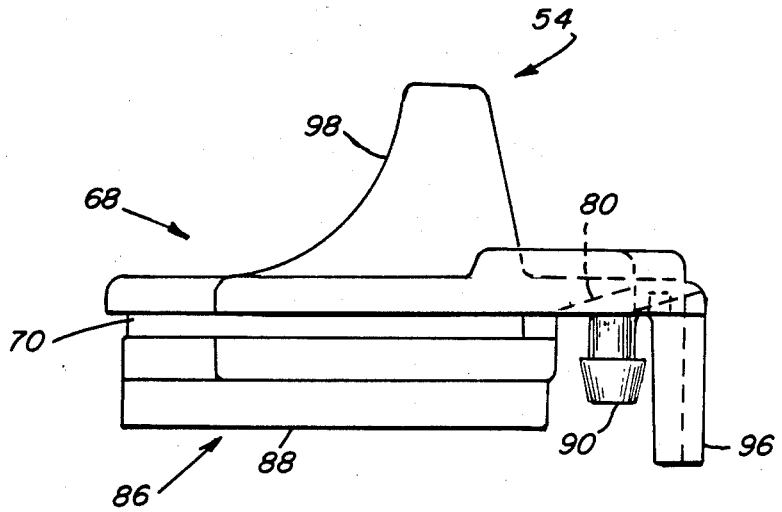
FIG. 3 is a side elevational view of the slidable portion.
Figure 4:
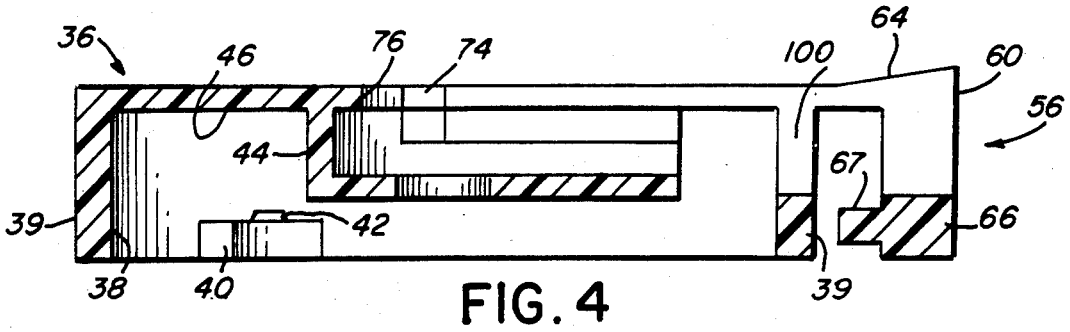
FIG. 4 is a sectional view taken along the line 4—4 of FIG. 1.

The slidable portion 54 has a body 68 formed to provide a keyway 70 which engages opposite walls 72 and 74 and front wall 76 of opening 50 in cover 36. The underside 78 of portion 54 has a pair of spaced, ramped indentations 80,82 (see FIG. 2) which engage raised sections 62, 64 when slidable portion 54 is in its open position. A cavity 84 is also provided on underside 78. Cavity 84 accepts aperture sealing member 86 which provides a bottom surface 88 which closes aperture 48 in boss 44 when slidable portion 54 is in the closed position.

Underside 78 is also provided with a spring retaining stud 90 which receives the coiled center section 92 of a linear spring 94. The stud 90 is positioned just forward of a peripheral closing section 96 which depends from underside 78. Closing section 96 has a width which allows it to pass between spaced projections 58, 60.

Slidable portion 54 is also provided with a finger engaging portion 98 to facilitate opening.

Figure 5:
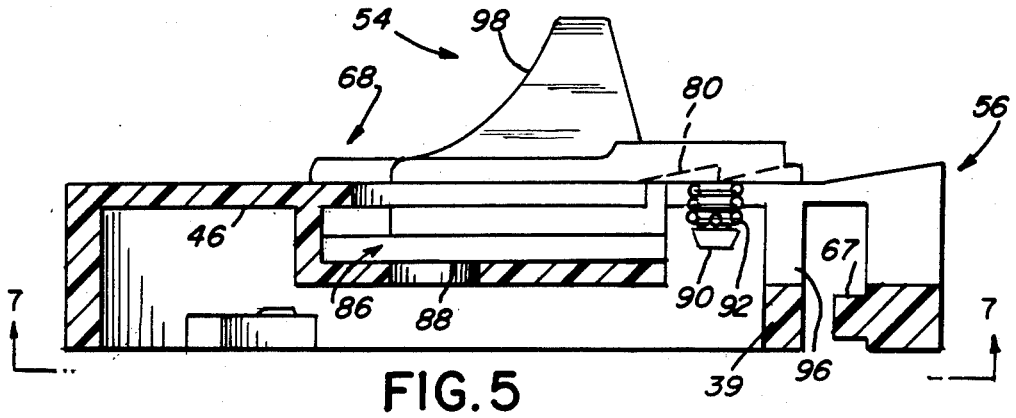
FIG. 5 is a sectional view similar to FIG. 4 illustrating the slidable portion in a closed position.
Figure 6:
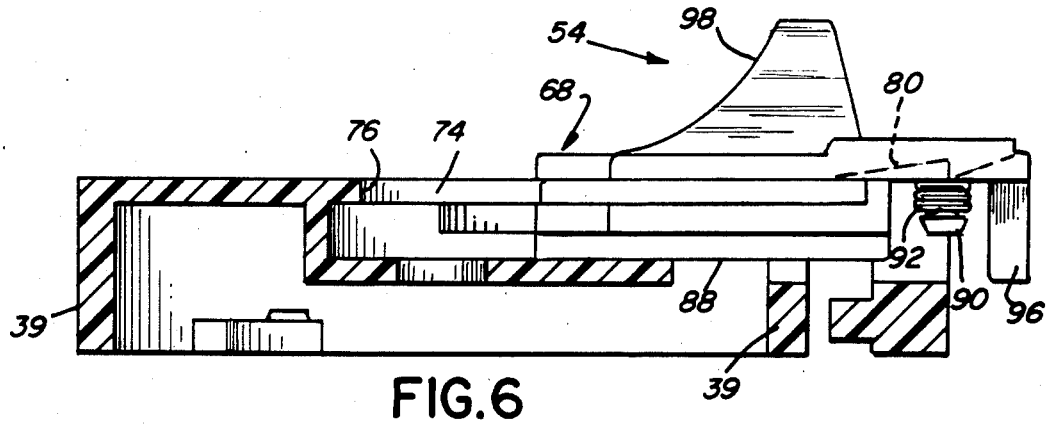
FIG. 6 is a sectional view similar to FIG. 5 illustrating the slidable portion in an open position.
Figure 7:
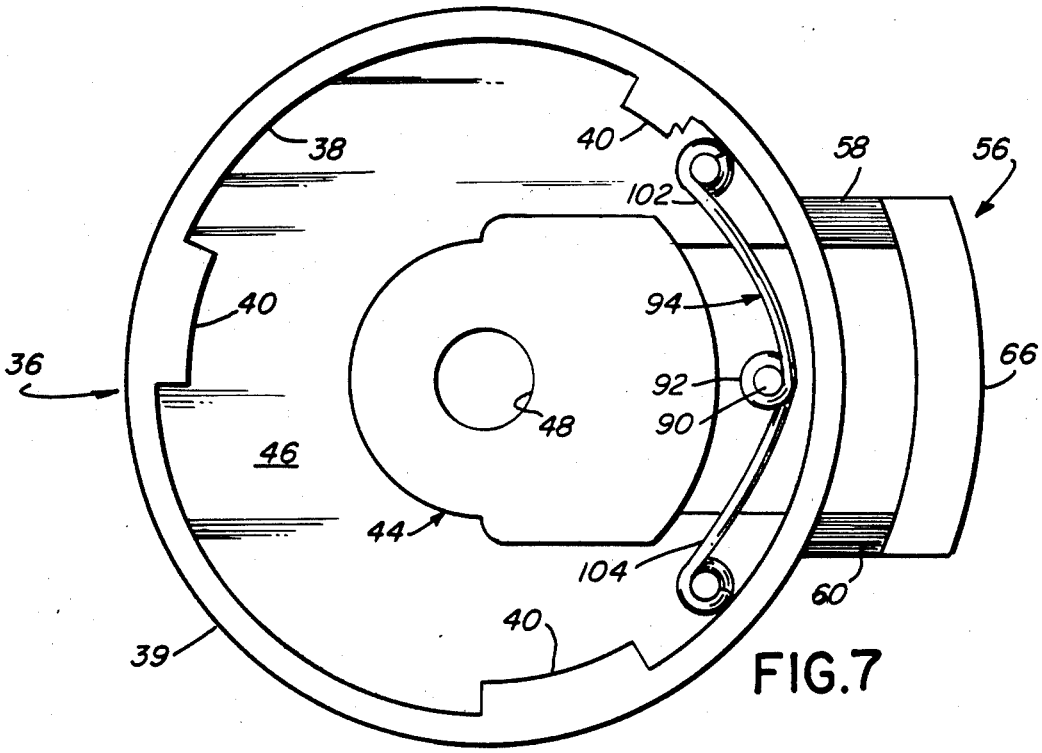
FIG. 7 is a plan view taken in the direction of line 7—7 of FIG. 5.

As can best be seen from FIGS. 5 and 7, when slidable portion 54 is assembled to cover 36, and is in the closed position, the peripheral cover closing section 96 fill the gap 100 formed in the wall 39 of cover 36. The keyway 70 engages the walls 72, 74 and 76 of opening 50 and bottom surface 88 closes aperture 48.

Linear spring 94 has its coiled center section 92 engaged by stud 90 and the oppositely extending arms 102, 104 engage the interior periphery 38 of wall 39 (see FIG. 7).

To open the container 10, slidable portion 54 is moved along its axis toward holding and releasing means 56. The ramped indentations 80, 82 engage the raised sections 62, 64, and tension is built up in spring 94 via coiled section 92. Thus the slidable portion remains open by virtue of the locking effect of the raised portions and the ramped indentations.

To close the container 10 it is only necessary to apply pressure to release bar 66 in a direction away from slidable portion 54. The pressure on the release bar 66 removes the raised sections 62, 63 from engagement with the ramped indentations 80,82 and allows spring 94 to return slidable portion 54 to its closed portion.

Thus, it will be seen that this container 10 provides many advantages over those of the prior art.

Worker radiation exposure is reduced because it is not necessary to remove the entire top to withdraw the contents. Further, even when open, only the small opening defined by aperture 48 is exposed. The container can be used to transport concentrated isotopes as well as prepared radio-prescriptions in multi-dose quantities, and, it is reusable.

While there have been shown and described what are at present considered to be the preferred embodiments of the invention, it will be apparent to those skilled in the art that various changes and modifications can be made herein without departing from the scope of the invention as defined by the appended claims.

I claim:

1. A multi-dose container for radio isotopes, said container comprising a first hollow body formed of a material substantially impervious to radiation and having a first cover sealed thereto, said first cover being substantially impervious to radiation and having a formed depression in the upper surface thereof, said depression containing a first aperture communicating with the interior of said first body; a second body having a hollow cavity formed to receive said first body; a second cover for closing said second body; a dependent boss formed on the interior surface of said second cover, said boss having a configuration formed to match the formed depression in said first cover; a second aperture in said boss in alignment with said first aperture; a slidable portion formed to engage an opening in the upper surface of said second cover; and slidable portion holding and releasing means on said second cover.

2. The container of claim 1 wherein said slidable portion holding and releasing means comprises a pair of spaced projections extending from said second cover, said projections having a raised section on a surface thereof and a release bar connected between said projections.

3. The container of claim 2 wherein said slidable portion has ramped indentations formed on an underside thereof for cooperating with said raised sections to maintain said slidable portion in an open position whereby access to said apertures is available.

4. The container of claim 3 wherein said slidable portion is spring loaded.

5. The container of claim 4 wherein said slidable portion has a spring retaining stud formed on the underside thereof.

6. The container of claim 5 wherein said spring loading is accomplished by a linear wire spring having a coiled center section which engages said stud and oppositely extending arms which engage an interior wall of said second cover.

7. The container of claim 6 wherein said slidable portion is formed with a keyway and opposite walls of said opening in the upper surface of said second cover form keys for cooperation therewith.

8. The container of claim 7 wherein said slidable portion has a bottom surface which closes said aperture in said boss when said slidable protion is in the closed position.

9. The container of claim 8 wherein said movement of said slidable portion from a closed position to an open position increases tension in said spring and movement of said release bar in a direction away from said slidable portion disengages said raised sections from said ramped indentations and allows said spring to return said slidable portion to said closed position.

* * * * *